US006417608B1

(12) United States Patent
Choi et al.

(10) Patent No.: US 6,417,608 B1
(45) Date of Patent: Jul. 9, 2002

(54) SHADOW MASK/FRAME ASSEMBLY FOR COLOR CATHODE RAY TUBE

(75) Inventors: Dai-ok Choi, Suwon; Dong-hwan Kim, Pusan; Young-kook Park, Suwon; Jae-ho Jeong; Myung-sup Seo, both of Pusan, all of (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 177 days.

(21) Appl. No.: 09/580,973

(22) Filed: May 30, 2000

(30) Foreign Application Priority Data

May 31, 1999 (KR) ..... 99-19758

(51) Int. Cl.[7] ..... H01J 29/80
(52) U.S. Cl. ..... 313/407; 312/402
(58) Field of Search ..... 313/402, 403, 313/407

(56) References Cited

U.S. PATENT DOCUMENTS 4,737,681 A * 4/1988 Dietch et al. ..... 313/402
RE33,253 E * 7/1990 Strauss ..... 313/402
4,994,712 A * 2/1991 Strauss ..... 313/405

* cited by examiner

*Primary Examiner*—Robert H. Kim
*Assistant Examiner*—Jurie Yun
(74) *Attorney, Agent, or Firm*—Lowe Hauptman Gilman & Berner, LLP

(57) ABSTRACT

A shadow mask/frame assembly for a color CRT includes a shadow mask including a hole portion having a predetermined curvature where a plurality of electron beam passing holes are formed and a bending portion extending from the edge of the hole portion by being bent at a predetermined angle, and a frame including a skirt portion coupled to the bending portion of the shadow mask, a flange portion extending from the skirt portion by being bent at a right angle thereto, a connection portion extending downward from the flange portion, and an extension portion extending from the connection portion, parallel to the flange portion.

4 Claims, 4 Drawing Sheets

SHADOW MASK/FRAME ASSEMBLY FOR COLOR CATHODE RAY TUBE

BACKGROUND OF THE INVENTION

1. Field of the Invention

The present invention relates to a shadow mask/frame assembly for a color cathode ray tube (CRT), and more particularly, to a shadow mask/frame assembly for a color cathode ray tube in which a frame installed at a panel is improved.

2. Description of the Related Art

FIGS. 1 and 2 are a sectional view of a typical color CRT and an exploded perspective view showing a shadow mask frame assembly for a color CRT installed at the color CRT, respectively. Referring to the drawings, a typical color CRT includes a panel 11 on an inner surface of which a fluorescent film 11*a* is formed, and a funnel 30 coupled to the panel 11. An electron gun 15 is installed at a neck portion 14 of the funnel 30 and a deflection yoke 20 is installed at a cone portion 12 of the funnel 30.

Also, the typical color CRT has a shadow mask frame 10. The shadow mask frame 10 includes a shadow mask 16 installed to be separated a predetermined distance from the fluorescent film 11 a, a frame 17 supporting the shadow mask 16, and an inner shield 21 of a rectangular funnel shape which is coupled to the frame 17. A skirt portion 17*a* for supporting the shadow mask 16 by being welded thereto is formed at the frame 17. A flange portion 17*b* bent toward the inner side is extended from the skirt portion 17*a* so that the flange portion 17*b* is coupled to the inner shield 21.

The shadow mask 16 includes a hole portion 16*c* having a plurality of electron beam passing holes, a hole-free portion 16*b* extending from the edge of the hole portion 16*c*, and a bending portion 16*a* extending downward at a right angle from the hole-free portion 16*b* and fixed to the skirt portion 17*a*.

A hook spring 19 fixed to the outer surface of the frame 17 is coupled to a stud 18 installed on the inner surface of the panel 11 and the shadow mask frame assembly 10 is installed at the inner surface of the panel 11.

The weight of the frame 17 increases as the size of the color CRT increases. Typically, a panel member having a thickness of about 1.2 mm is used for the color CRT less than 14 inches whereas a thin panel having a thickness of about 0.8 mm is used for a color CRT about 14–29 inches to reduce the weight thereof. When these thin panels are used, the support force of the frame 17 to the shadow mask 16 decreases so that the shadow mask 16 is deformed when an external impact is applied or during the manufacturing process.

Also, an electron beam emitted from the electron gun is selectively deflected by the deflection yoke 20 and passes through the holes of the shadow mask 16 for color selection, and excites the fluorescent film 11*a*. Here, the electron beam input to the edge of the shadow mask 16 is reflected on the flange portion 17*b*, generating diffusion-reflection. Furthermore, although not shown in the drawings, the diffused electron beam passes through the electron beam passing hole of the shadow mask 16 and excites an undesired pixel. To solve the above problems, a method of bending an end portion of the flange portion 17*b* at a predetermined angle toward the shadow mask 16 has been suggested. However, the sufficient structural strength of the frame 17 and sufficient prevention of the diffusion-reflection cannot be expected.

SUMMARY OF THE INVENTION

To solve the above problems, it is an objective of the present invention to provide a shadow mask/frame assembly having an improved frame structure so that the shadow mask can be prevented from being deformed by an external impact and the diffusion-reflection can be prevented.

Accordingly, to achieve the above objective, there is provided a shadow mask/frame assembly for a color CRT which comprises a shadow mask including a hole portion having a predetermined curvature where a plurality of electron beam passing holes are formed and a bending portion extending from the edge of the hole portion by being bent at a predetermined angle, and a frame including a skirt portion coupled to the bending portion of the shadow mask, a flange portion extending from the skirt portion by being bent at a right angle thereto, a connection portion extending downward from the flange portion, and an extension portion extending from the connection portion, parallel to the flange portion.

It is preferable in the present invention that an end portion of the extension portion has a knife edge shape for allowing an electron beam colliding with the extension portion to be diffusely reflected to the area except for the hole portion.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 3:
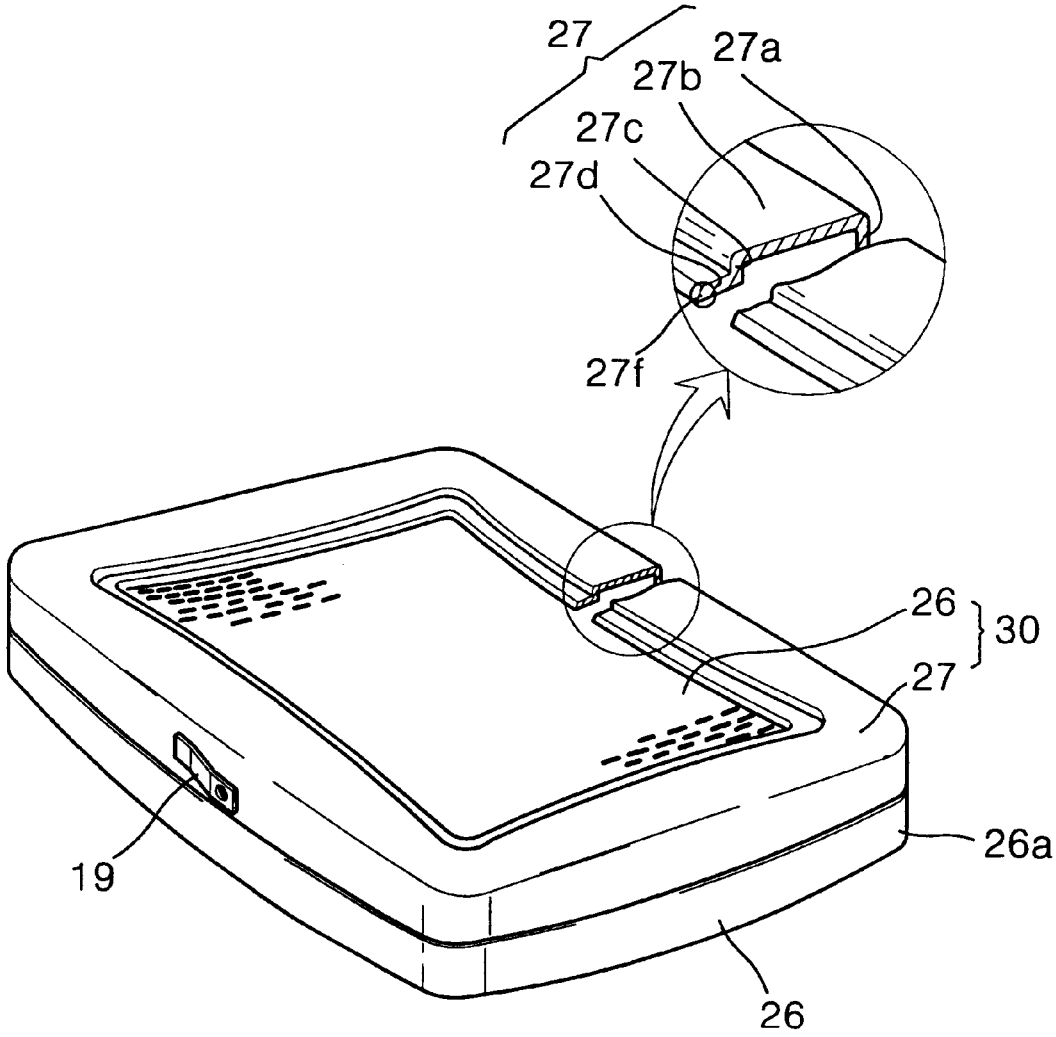
FIG. 3 is a perspective view showing a shadow mask/frame assembly for a color CRT according to a preferred embodiment of the present invention.

Referring to FIG. 3, a shadow mask/frame assembly 30 for a color CRT according to a preferred embodiment of the present invention includes a shadow mask 26 and a frame 27 which are coupled to each other.

The shadow mask 26 includes a hole portion having a predetermined curvature, where a plurality of electron beam passing holes are formed, and a bending portion 26*a* extending from the edge of the hole portion by being bent at a predetermined angle. The shadow mask 26 is installed in a panel (not shown) and has a color selection function.

The frame 27 includes a skirt portion 27*a* coupled to the bending portion 26*a* of the shadow mask 26, a flange portion 27*b* extended from the skirt portion 27*a* by being bent at a right angle thereto, a connection portion 27*c* extending from the edge of the flange portion 27*b*, and an extension portion extended from the connection portion 27*c*parallel to the flange portion 27*b*. Here, an end portion 27*f* of the extension portion 27*d* is preferably formed to have a knife edge shape to diffusion-reflect an electron beam emitted from an electron gun to the area except for the hole portion of the shadow mask 26.

Figure 1:
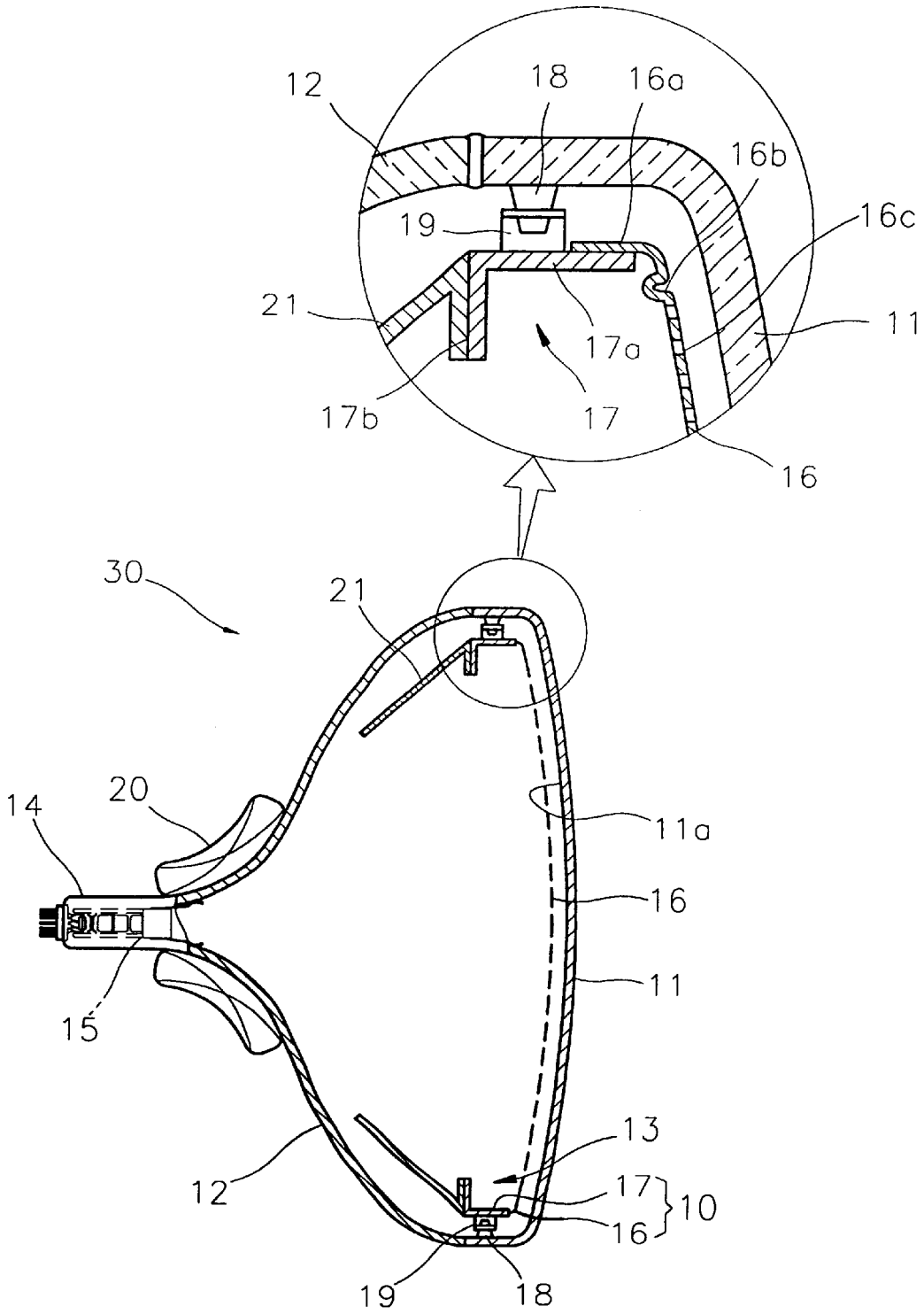
FIG. 1 (PRIOR ART)
FIG. 1 is a sectional view of a typical color CRT.
Figure 2:
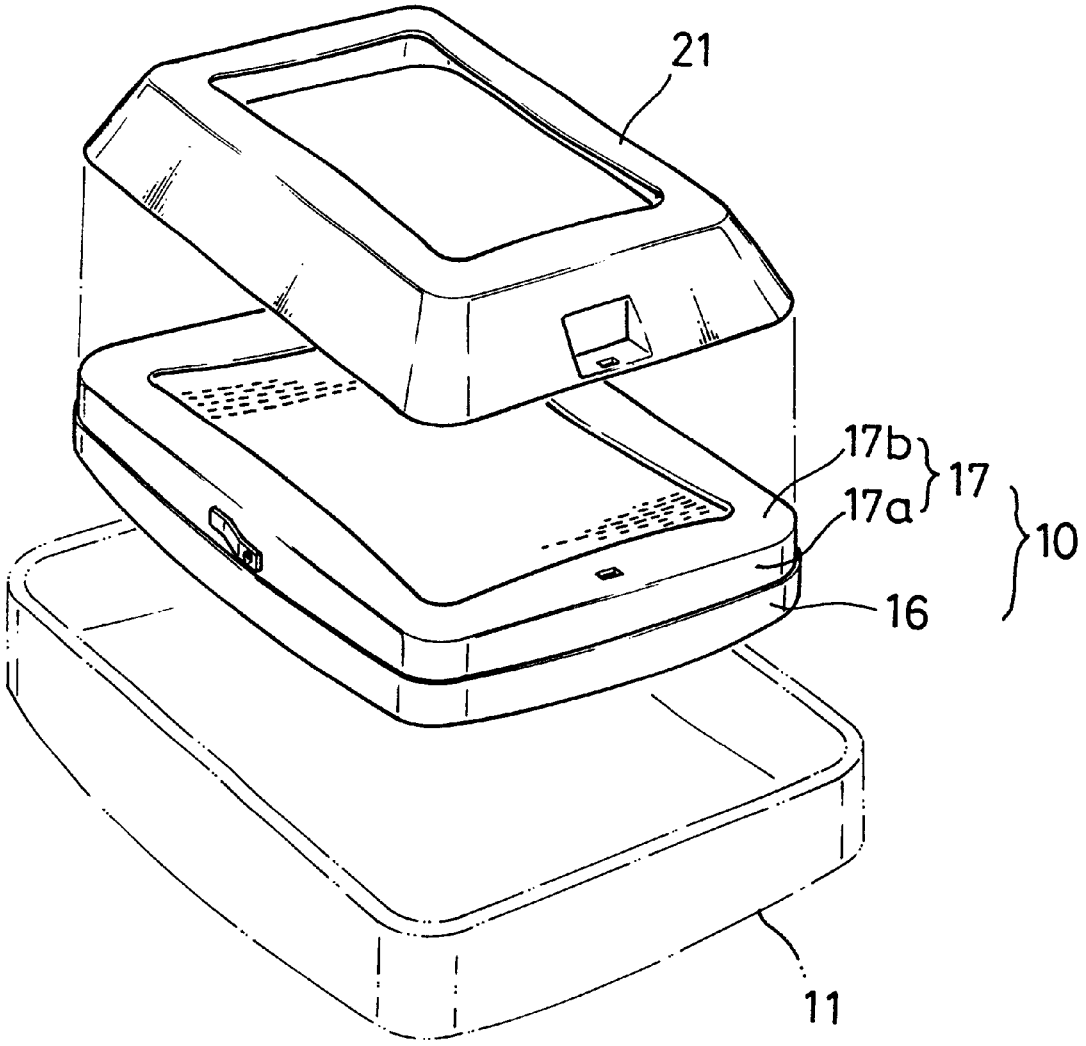
FIG.2 (PRIOR ART)
FIG. 2 is an exploded perspective view showing the frame assembly of a shadow mask for a typical color CRT.

In the shadow mask/frame assembly 30 for a color CRT according to a preferred embodiment of the present invention having the above structure, the bending portion 26*a* of the shadow mask 26 is fixedly welded to the skirt portion 27*a* of the frame 27. The shadow mask/frame assembly 30 is installed at the panel as the hook spring 19 fixed to the outer circumferential surface of the frame 27 is coupled to the stud (18 of FIG. 1) installed at the inner surface of the panel. It is the same as that depicted in FIG. 1.

The inner shield (not shown) is coupled to the flange portion 27*b* of the frame 27 of the shadow mask/frame assembly 30 installed at the panel. The frame 27 is blocks the diffusion-reflection of the electron beam emitted from the electron gun and also reinforces the strength of the frame 27. That is, an inclined surface of the knife edge shaped end portion 27*f* of the extension portion 27*d* diffusely reflects the electron beam toward the area except for the hole portion. Thus, when the electron beam is not input to the hole portion and collides with the knife edge shaped end portion 27*f*, the electron beam is diffusely reflected to the area except for the hole portion by the inclined surface so that the fluorescent film of undesired other colors can be prevented from being excited. Therefore, an electron beam colliding with the knife edge shaped end portion 27*f* is prevented from being input to the shadow mask 26, and only a normal electron beam is input to the shadow mask 26 and passes through the electron beam passing hole formed in the shadow mask 26 to be scanned on the fluorescent film to form an image.

Also, the extension portion 27*d* is connected to the flange portion 27*b* through the connection portion 27*c*, forming a step, and serves as a bead. Thus, the structural strength of the frame 27 can be improved. Furthermore, the fame 27 having a structure of being bent into multiple steps can prevent the shadow mask 26 from being vibrated by external vibrations or a small impact.

Figure 4:
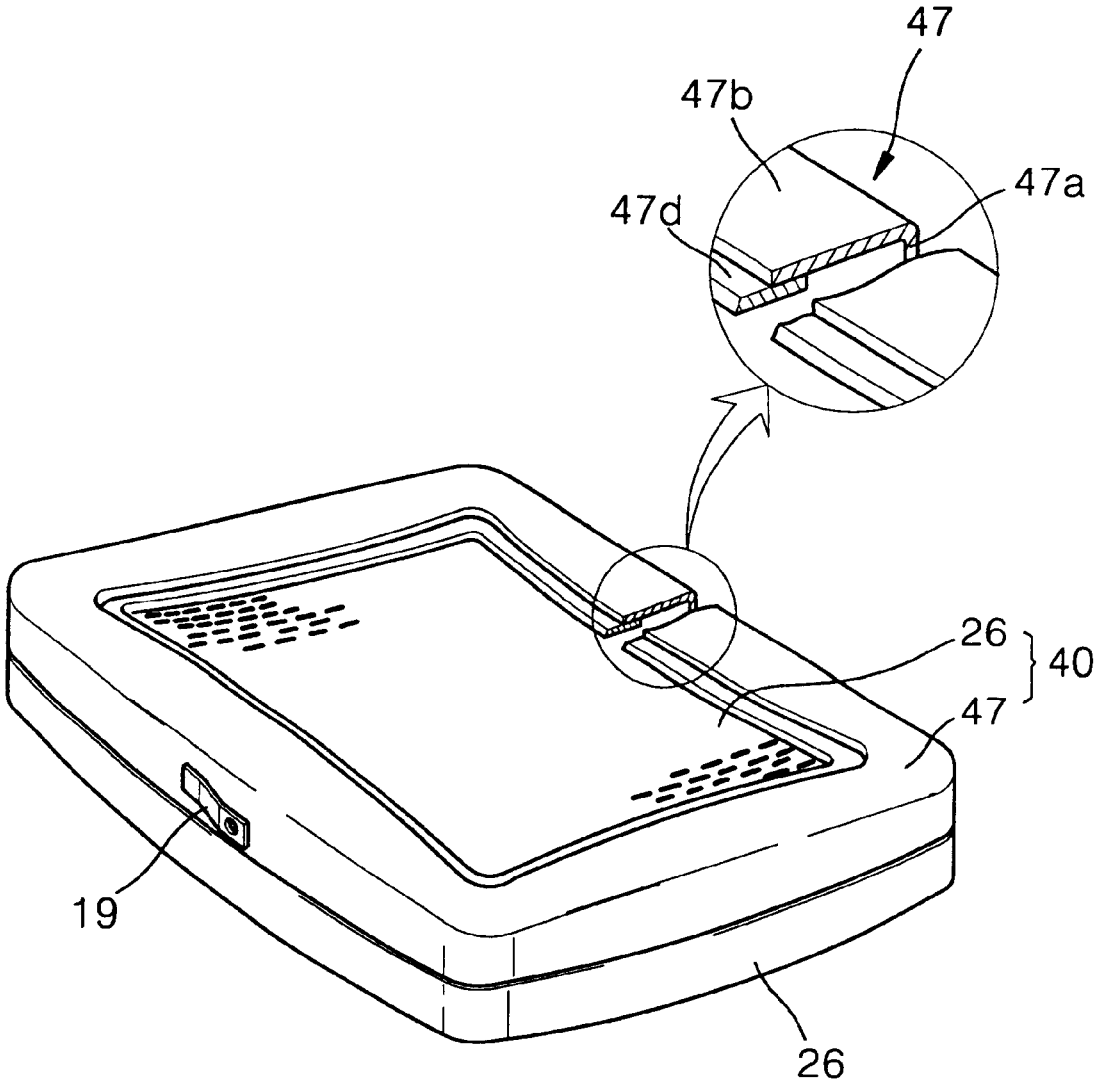
FIG. 4 is a perspective view showing a shadow mask/frame assembly for a color CRT according to another preferred embodiment of the present invention.

FIG. 4 shows a shadow mask/frame assembly for a color CRT according to another preferred embodiment of the present invention. Here, the same reference numerals as those in the previous drawings indicate the same elements having the same functions. Referring to the drawing, a shadow mask/frame assembly 40 according to the present embodiment includes a frame 47 having an extension portion 47*d* contacting the lower surface of a flange portion 47*b* and parallel to the flange portion 47*b*.

In the above structure, the flange portion 47*b* and the extension portion 47*d* are separately manufactured and combined through spot welding. As other structure, and effects thereof are the same as those of the embodiment described above, a detailed description of the present embodiment will be omitted.

As described above, in the shadow mask/frame assembly according to the present invention, as the extension portion is formed at the end of the flange portion to have a step, the structural intensity of the frame is improved so that a relatively thin frame can be manufactured. Also, the electron beam emitted from the electron gun colliding with the edge of the flange portion can be prevented from exciting the fluorescent film of the other colors.

It is noted that the present invention is not limited to the preferred embodiment described above, and it is apparent that variations and modifications by those skilled in the art can be effected within the spirit and scope of the present invention defined in the appended claims.

What is claimed is:

1. A shadow mask/frame assembly for a color CRT comprising:

a shadow mask including a hole portion having a predetermined curvature where a plurality of electron beam passing holes are formed and a bending portion extending from the edge of the hole portion by being bent at a predetermined angle; and a frame including a skirt portion coupled to the bending portion of the shadow mask, a flange portion extending from the skirt portion by being bent at a right angle thereto, a connection portion extending downward from the flange portion, and an extension portion extending from the connection portion, parallel to the flange portion.

2. The assembly as claimed in claim 1, wherein an end portion of the extension portion has a knife edge shape for allowing an electron beam colliding with the extension portion to be diffusely reflected to the area except for the hole portion.

3. The assembly as claimed in claim 1, wherein the extension portion of the frame contacts a lower surface of the flange portion to be parallel to the flange portion.

4. The assembly as claimed in claim 2, wherein the extension portion of the frame contacts a lower surface of the flange portion to be parallel to the flange portion.

* * * * *